US006344005B1

(12) United States Patent
Lin

(10) Patent No.: US 6,344,005 B1
(45) Date of Patent: Feb. 5, 2002

(54) HOOP FOR BASKETBALL

(76) Inventor: Che Jen Lin, No. 14-90, Li Ming Rd., I Lan City, I Lan County (TW)

( * ) Notice: Subject to any disclaimer, the term of this patent is extended or adjusted under 35 U.S.C. 154(b) by 0 days.

(21) Appl. No.: 09/477,372

(22) Filed: Jan. 4, 2000

(51) Int. Cl.[7] ..... A63B 67/00
(52) U.S. Cl. ..... 473/415; 473/481; 473/483
(58) Field of Search ..... 473/415, 476, 473/479, 481, 483, 485, 486

(56) References Cited

U.S. PATENT DOCUMENTS 3,017,183 A * 1/1962 Chalcroft ..... 473/483
5,823,898 A * 10/1998 Wang ..... 473/483

* cited by examiner

*Primary Examiner*—Jeanette Chapman
*Assistant Examiner*—M. Chambers
(74) *Attorney, Agent, or Firm*—Bacon & Thomas, PLLC

(57) ABSTRACT

A basketball hoop. The basketball hoop includes a hoop, a connecting board provided with holes on lateral sides thereof, a securing deck, a pivot, at least one torsional spring, and one end of the hoop extends outwards and is coupled into the connecting board. A connector includes a pair of fixing poles, a pair of symmetrical combined pedestals each attached to a respective one of the fixing poles, and a hole is provided on each side of the combined pedestals. The holes of the connecting board correspond to the holes of the combined pedestals, such that the pivot passes through the holes of the connecting board, the one or more torsional springs and the holes of the combined pedestals. The connector further includes a pair of symmetrical long plates with a fixture on an end of each of the long plates, and the long plates and the fixing poles are spaced apart from one another.

1 Claim, 8 Drawing Sheets

HOOP FOR BASKETBALL

BACKGROUND OF THE INVENTION

1. Field of the Invention

The present invention relates to the field of a hoop for basketball, and more particularly to a hoop which is easily adjustable its altitude.

2. Description of the Related Art

With reference to the FIG. 6 and 7, the known basketball hoop 2 includes one hoop 21, one securing deck 22, one pivot 23 and one or more torsional springs 24. Starting from one end of hoop 21, the hoop 21 extends outwards in order to connect with a connecting board 211. There is one circular hole 212 drilled at the each lateral side of the connecting board 211. The front end of securing deck 22 includes a pair of symmetrical combined pedestals 221. In addition, there is a circular hole 222 drilled at each side of the combined pedestals 221, each corresponding to a respective one of the circular holes 212 in order that the pivot 23 is passed through the connecting board 211, the one or more torsional springs 24 and the combined pedestals 221, in such a way as to combine the hoop 21 and the securing deck 22 so that the hoop 21 can swivel to a certain angle and is able to withstand certain pressures.

With reference to the FIG. 8, it is allowable for a known basketball hoop 2 to attach on a crossbar by its securing deck 22 but when the height needs to be adjusted it is necessary to adjust the height for both the hoop and the crossbar. The structure for the securing deck 22 of the known basketball hoop is very weak since it only consists of a simple n-shaped structure and with such design, when a basketballer performs a slam-dunk or dunk shot, although the impact force can be abated by the one or more torsional springs 24 installed under the connecting board 211, but if the impact force is too strong or too long, then the securing deck 22 can be fractured or disengaged from the crossbar easily and hence causing a dangerous situation to occur. There is a need for a basketball hoop that is free of these problems.

SUMMARY OF THE INVENTION

The primary purpose of the present invention is to provide a basketball hoop which is easily height adjustable.

The secondary purpose of the present invention is to provide a basketball hoop with a very high level of safety.

Thus, in light of the above purposes, the basketball hoop according to the present invention includes one hoop, one connector and one securing deck, wherein the connector is extending upwards in order to combine with one pair of symmetrical long plates, and there are two fixtures positioned at each side of long plate; additionally the connector extends downward from its bottom end so as to combine with one pair of symmetrical fixing poles, and moreover there is fixing rabbet and fixing hook which is attached respectively at the place located on the top of the securing deck while it is also relative to both the fixture of connector and the fixing pole; and going through downwards from the back side of securing deck there is an adjusting deck which has a plurality of coupling tines inside, and one pair of coupling hooks are installed symmetrically at each side of the adjusting deck.

The preferred embodiment of the present invention, its configuration, structure, and operation will now be further described in the following detailed description taken in conjunction with reference to the accompanying drawings.

DETAILED DESCRIPTION OF THE PREFERRED EMBODIMENTS OF THE INVENTION

Figure 1:
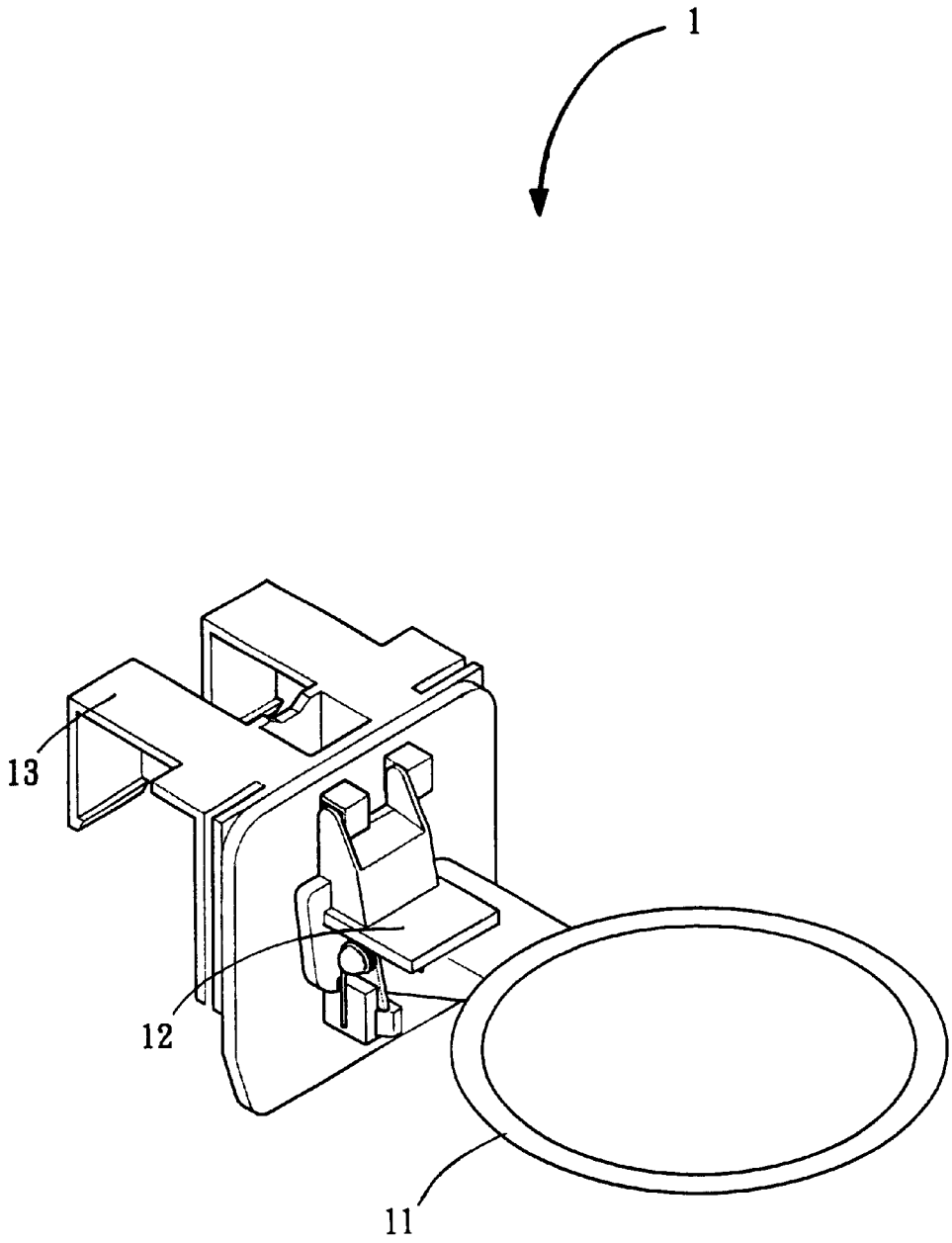
FIG. 1 is a perspective view of the present invention.
Figure 2:
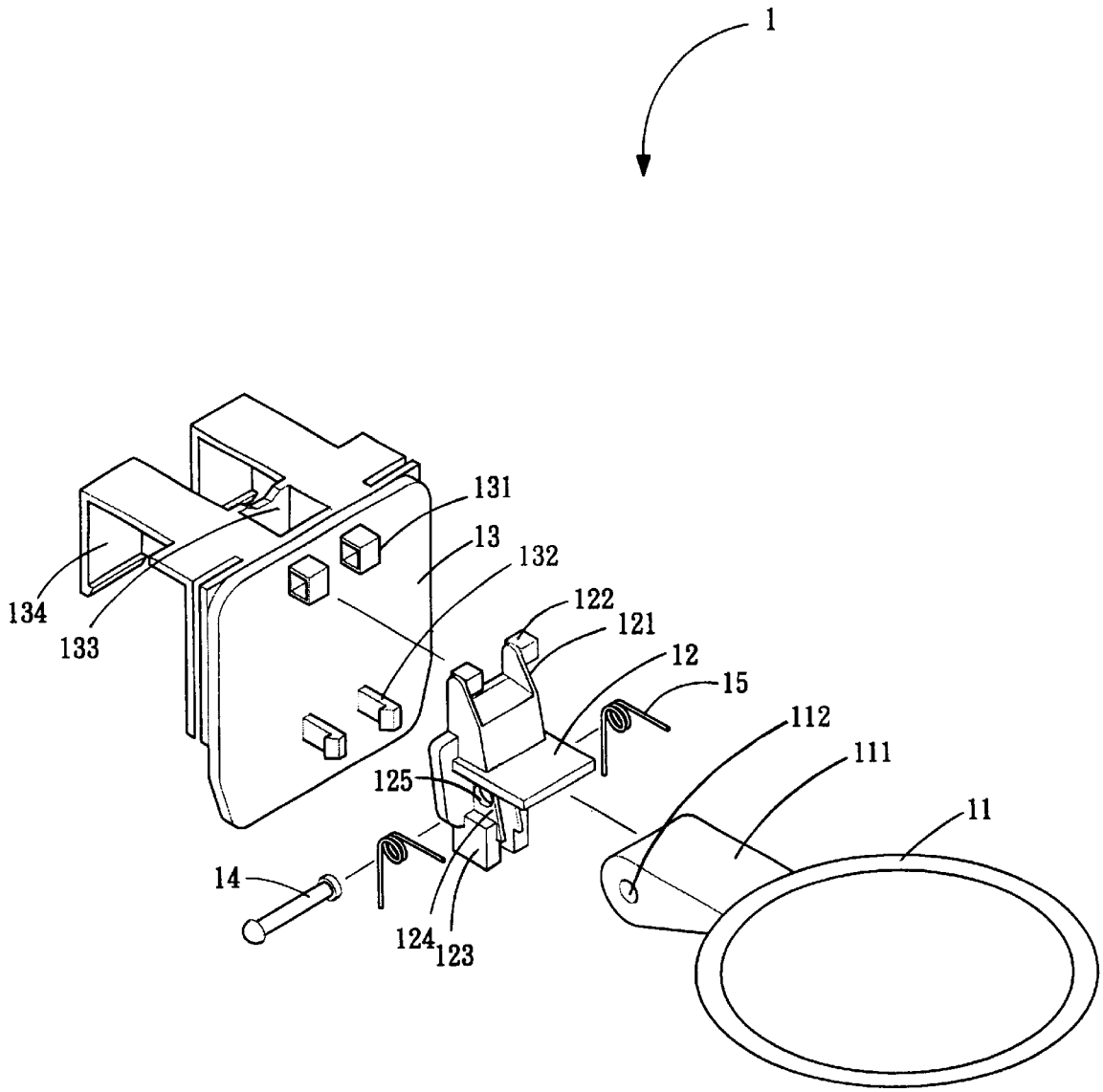
FIG. 2 is an exploded view of FIG. 1.
Figure 3:
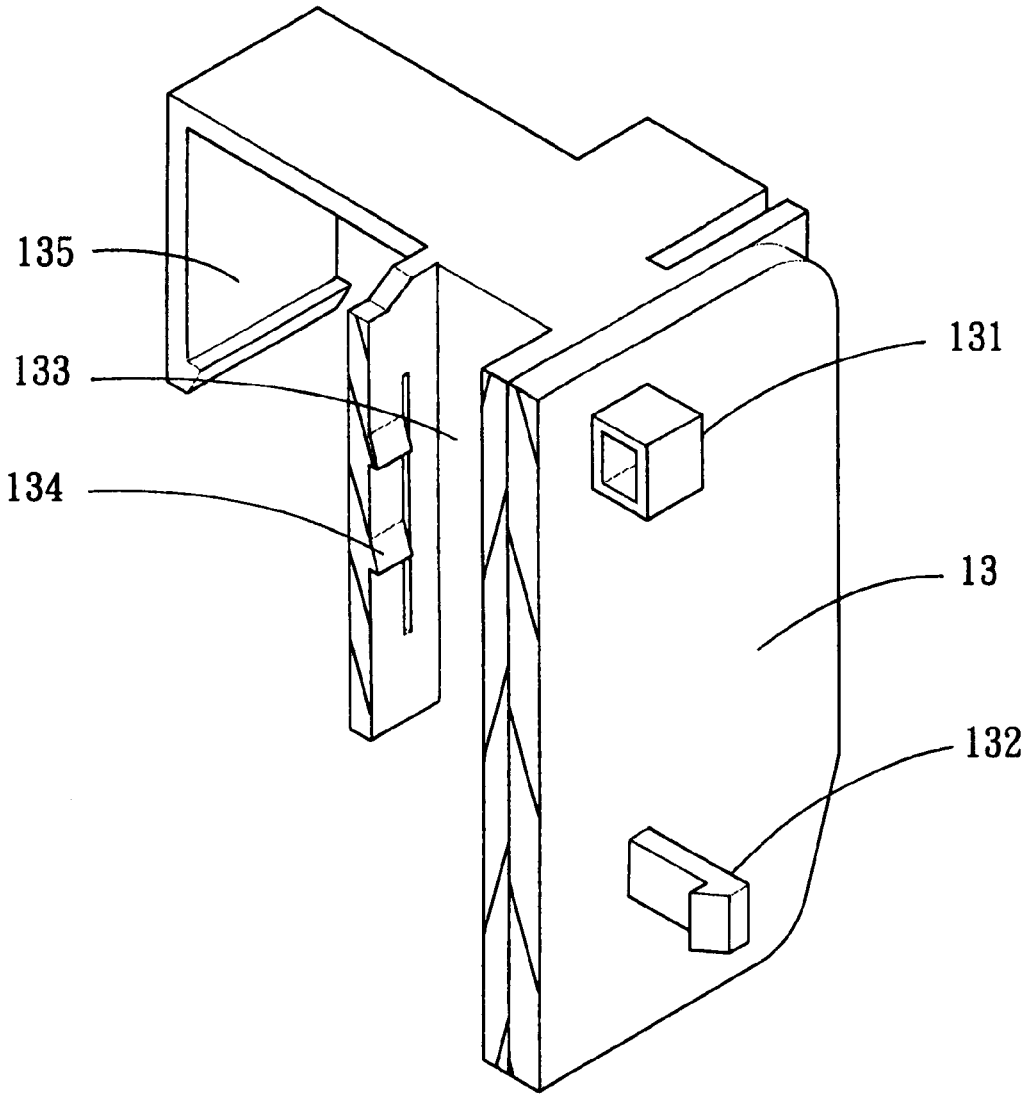
FIG. 3 is a schematic partially cut-away view of the securing deck according to the present invention.

With reference to the FIGS. 1 to 3, the present invention of the basketball hoop 1 includes one hoop 11, one connector 12, one securing deck 13, one pivot 14 and one or more torsional springs 15, wherein one end of hoop 11 extends outwards in order to form a connecting board 111; there is one circular hole 112 drilled at each lateral side of the connecting board 111. The connector 12 extends upwards in order to combine with one pair of symmetrical long plates 121, and there are two fixtures 122 each positioned at a side of the long plates 121. The connector 12 extends downwards from its bottom end so as to combine with one pair of symmetrical fixing poles 123 that are equipped with a pair of symmetrical combined pedestals 124 at its front ends. A circular hole 125 is drilled on each side of the combined pedestals 124 which corresponds to the circular holes 112 located on each side of the connecting board 111 so that the pivot 14 is able to pass through all the circular holes 112 on each of the connecting board 111, torsional spring 15 and the combined pedestal 124 of the hoop 11 . The basketball hoop 1 is combined all together in such a way that it is possible for the hoop 11 to swivel to a certain angle and also withstand a certain amount of pressure. Further, the fixing rabbet 131 and fixing hook 132 which are attached respectively in place at the securing deck 13, relative to both the fixture 122 of connector 12 and the fixing pole 123, and at the back side of the securing deck 123 there is an adjusting deck 133 which has a plurality of coupling tines 134 installed inside, and one pair of coupling hooks 135 are also installed symmetrically at each side of the adjusting deck 133.

Figure 4:
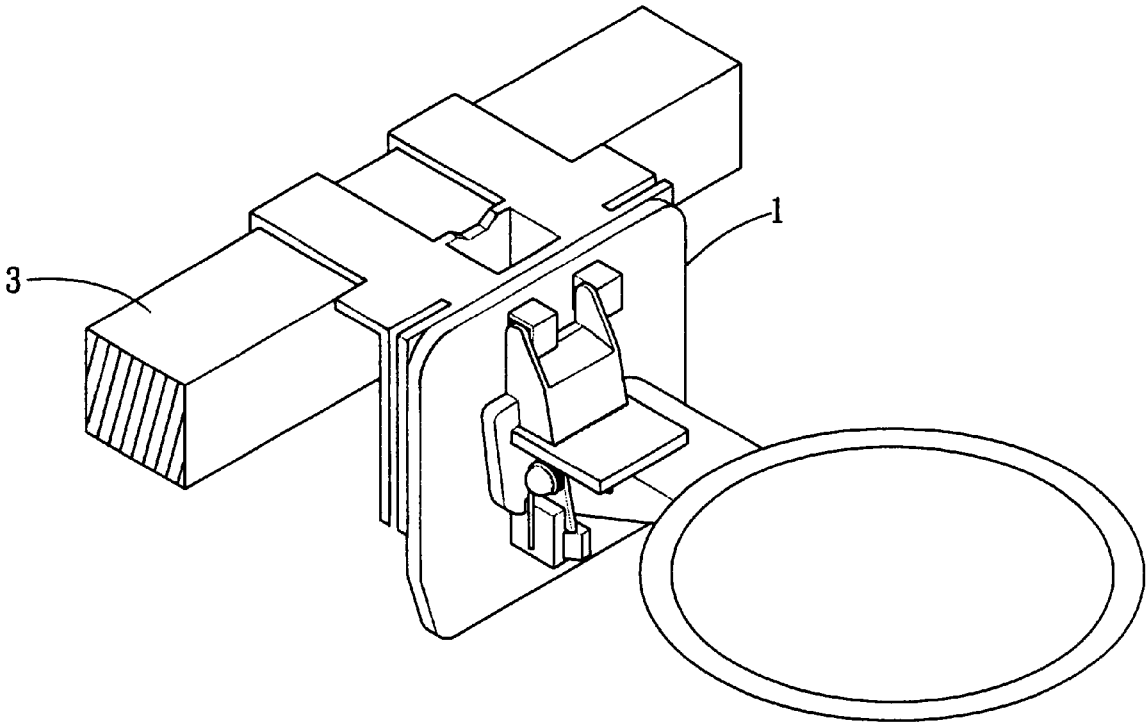
FIG. 4 is a schematic view according to a preferred embodiment of the present invention.
Figure 5:
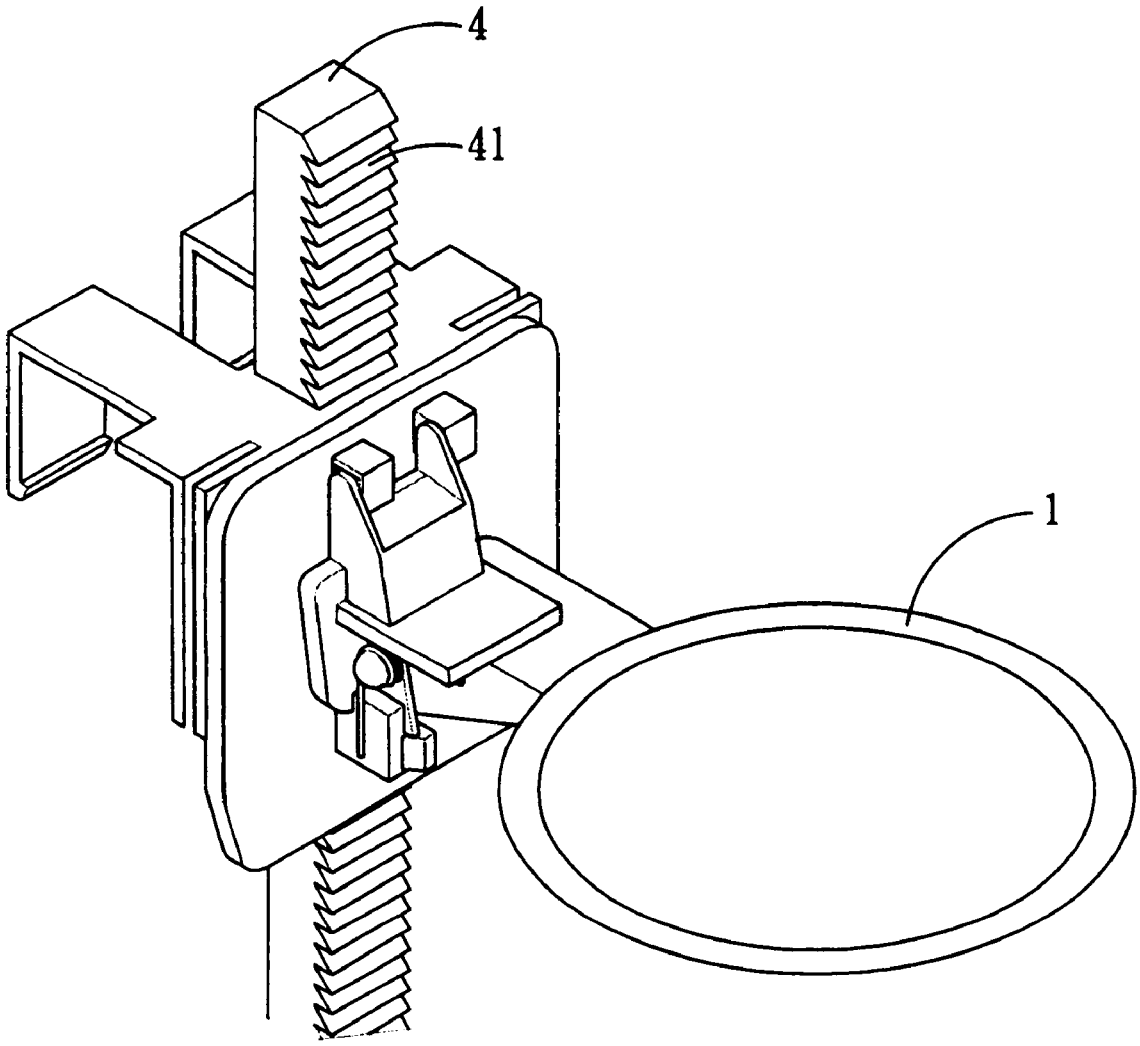
FIG. 5 is a schematic view according to another preferred embodiment of the present invention.
Figure 6:
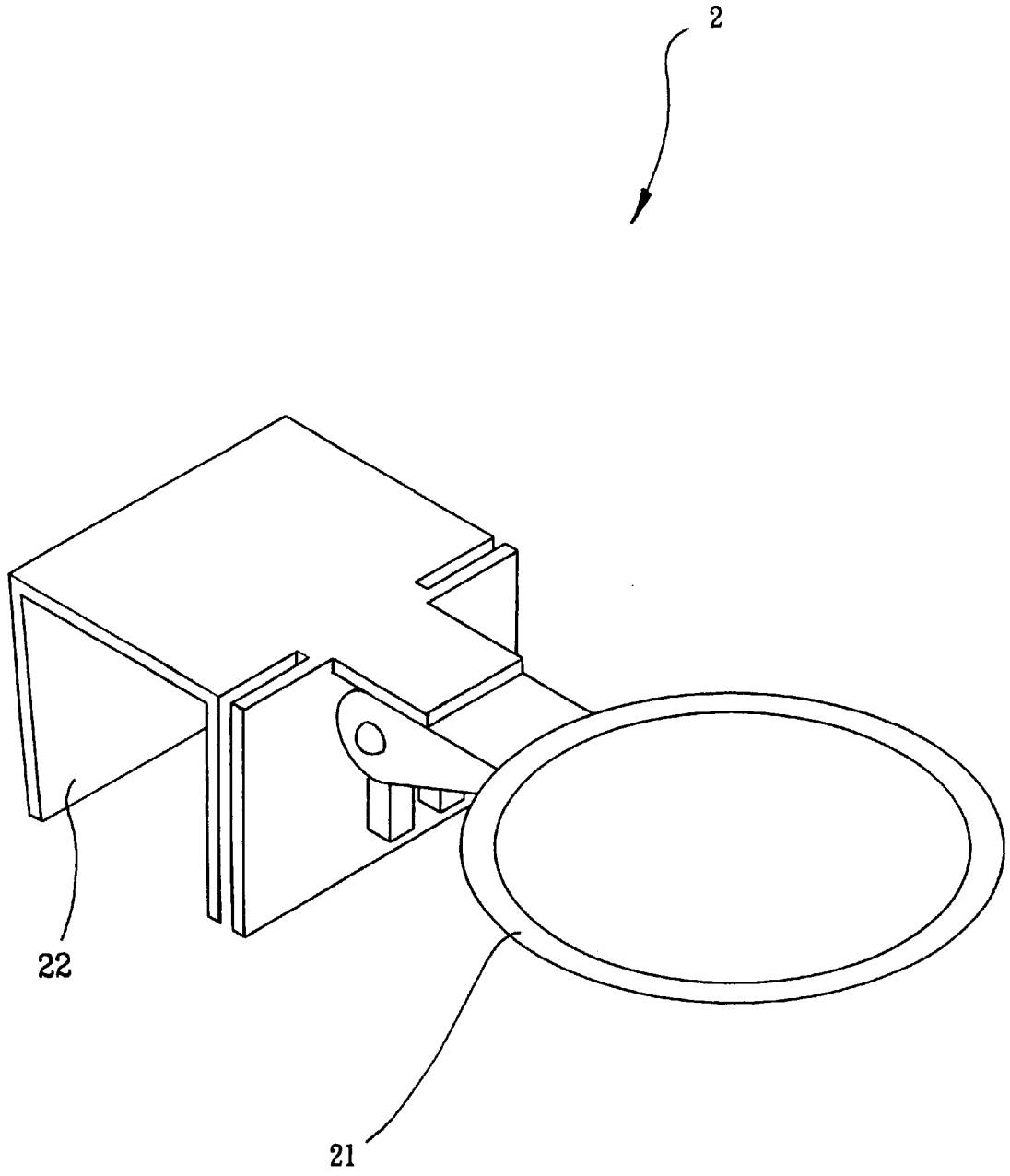
FIG. 6 (PRIOR ART)
FIG. 6 is a perspective view of a prior art basketball hoop.
Figure 7:
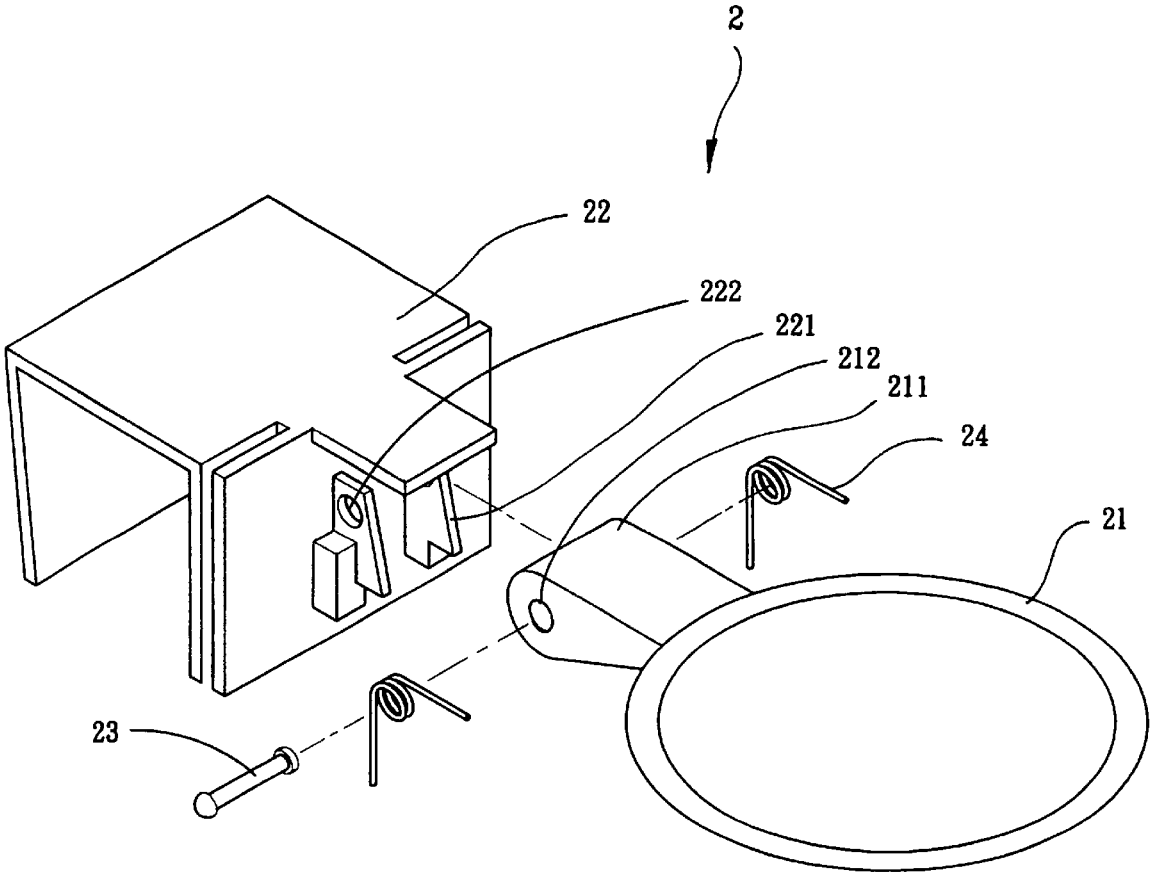
FIG. 7 (PRIOR ART)
FIG. 7 is an exploded perspective view of FIG. 6.
Figure 8:
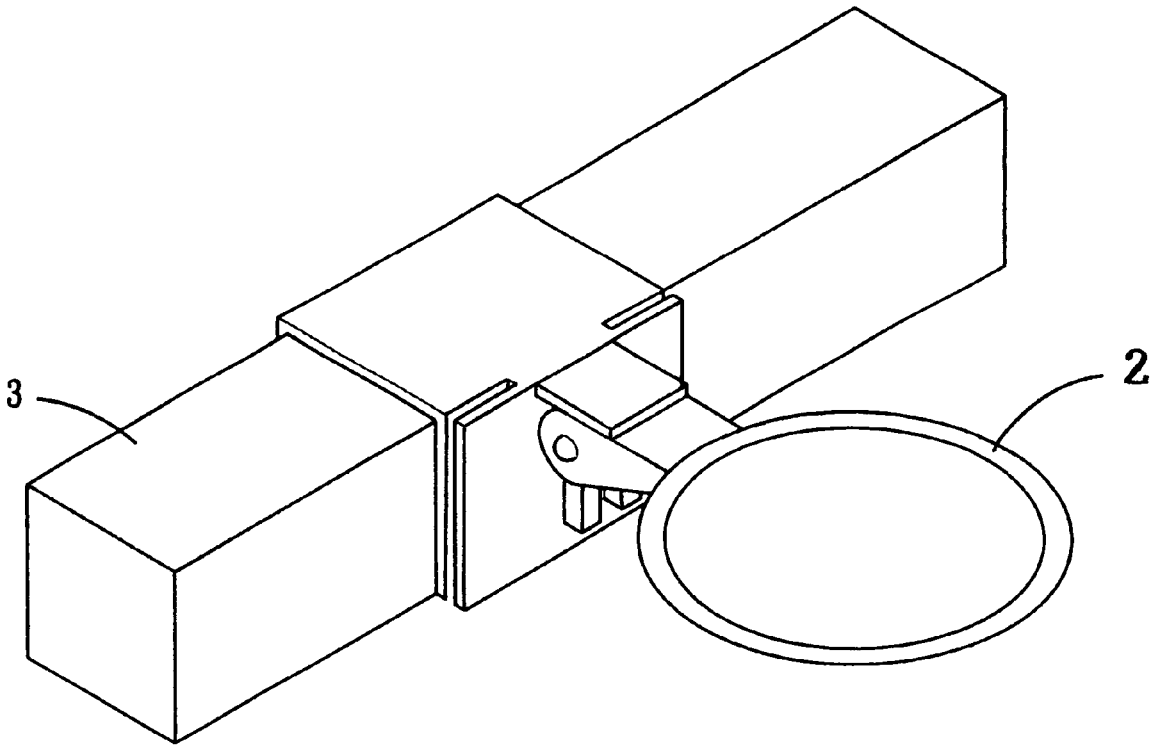
FIG. 8 (PRIOR ART)
FIG. 8 is a schematic view of the basketball hoop of FIG. 6 attached to a crossbar.

With reference to the FIGS. 4 and 5, the present invention of the basketball hoop 1 is shown in the fixture 122 of the connector 12 inserted into the fixing rabbet 131 of the securing deck 13, and also the fixing hook 132 at the bottom of the securing deck 13 coupled with the fixing pole 123 of the connector 12 so that the connector 12 and securing deck 13 are combined tightly, and the basketball hoop 1 is attached onto the crossbar 3, thus the coupling hook 135 positioned at the back side of the securing deck 13 is coupled with the bottom flange of the crossbar 3 and in this way the basketball hoop 1 will not easily detach from the crossbar 3. In addition, while coupling the adjusting deck 133 of the securing deck 13 into the adjustable pole 4 in this manner the height of the hoop can be adjusted step by step by means of the in-between coupling of the coupling tines 134, 41 accordingly, as shown in FIG. 5.

The basketball hoop according to the present invention includes the performances and advantages as follow:

The basketball hoop according to the present invention is coupled into the adjustable pole via the adjusting deck of the securing deck, so that the coupling tine on the adjustable pole will then be geared into the coupling tine on the adjusting deck, so that the hoop will be able to adjusted step by step to a desired height.

The basketball hoop according to the present invention combines the fixture and fixing pole of the connector togetherwith the fixing rabbet and fixing hook of the securing deck, to produce a structure that is much more secure than the previously known hoop structures. The coupling hook located at the back side of the securing deck, after the insertion into the crossbar, will be coupled with the bottom flange of the crossbar, and in this way the hoop will not easily fall off from the crossbar while maintaining the ability to withstand impact forces.

Due to the modular and simplified design of the present invention, whenever there is failure for any single component the basketball hoop according to the present invention, such items can be replaced and maintained easily. Additionally due to the square shaped design for both the fixture and the fixing rabbet the device can be reoriented by a 90 degree angle to permit quick assembly and save the space during storage by easily switching its orientation from vertical to the horizontal.

In view of the specific embodiment described herein, while the particular embodiment of the present invention has been illustrated and described, it would be obvious to those skilled in the art that various other changes and modifications can be made without departing from the spirit and scope of the invention. It is therefore intended to cover in the appended claims all such changes and -modifications that are within the scope of the present invention.

What is claimed is:

1. A basketball hoop comprising:

a hoop;

a connecting board provided with holes on lateral sides thereof;

a securing deck;

a pivot;

at least one torsional spring;

one end of the hoop extends outwards and is coupled into the connecting board;

a connector comprising a pair of fixing poles, a pair of symmetrical combined pedestals each attached to a respective one of the fixing poles, a hole provided on each side of the combined pedestals;

the holes of the connecting board corresponding to the holes of the combined pedestals, such that the pivot passes through the holes of the connecting board, the at least one torsional spring and the holes of the combined pedestals;

the connector further comprises a pair of symmetrical long plates with a fixture on an end of each of the long plates, the long plates and the fixing-poles are opposingly spaced apart from one another;

a securing deck comprising a pair of fixing rabbets and a pair of fixing hooks on a top surface thereof;

the connector detachably attached to the securing deck as each of the fixtures is inserted into a corresponding one of the fixing rabbets and each of the fixing hooks is secured to a corresponding one of the combined pedestals; and an adjusting deck attached to a rear side of the securing deck, the adjusting deck comprising a plurality of coupling tines and a pair of coupling hooks.

* * * * *